United States Patent [19]

Staats

[11] 4,264,228

[45] Apr. 28, 1981

[54] COMPOSITE LOOSELEAF MECHANISM

[75] Inventor: Henry N. Staats, Deerfield, Ill.

[73] Assignee: General Binding Corporation, Northbrook, Ill.

[21] Appl. No.: 91,900

[22] Filed: Nov. 7, 1979

Related U.S. Application Data

[63] Continuation of Ser. No. 873,277, Jan. 30, 1978, abandoned.

[51] Int. Cl.[3] ..... B42F 3/04

[52] U.S. Cl. ..... 402/22; 402/45; 402/69

[58] Field of Search ..... 402/19, 21, 22, 20, 402/26, 31, 35, 38, 42, 45, 60, 69, 76, 77

[56] References Cited

U.S. PATENT DOCUMENTS

| | | | |
|---|---|---|---|
| 2,017,188 | 10/1935 | Tannehill | 402/35 |
| 2,230,505 | 2/1941 | Thesieres | 402/28 |
| 2,459,541 | 1/1949 | Russell | 402/21 |
| 3,057,357 | 10/1962 | Duncan | 402/77 X |
| 3,111,949 | 11/1962 | Duncan et al. | 402/76 X |
| 3,162,198 | 12/1964 | Dennis | 402/30 |
| 3,251,364 | 5/1966 | Goldman | 402/22 |
| 3,252,461 | 5/1966 | Schade | 402/31 |
| 3,313,303 | 4/1967 | Beyer | 402/22 |
| 3,313,304 | 4/1967 | Beyer | 402/22 |
| 3,574,472 | 4/1971 | Cott | 402/22 |
| 4,056,326 | 11/1977 | Crawford | 402/30 |

*Primary Examiner*—Paul A. Bell

*Attorney, Agent, or Firm*—Hill, Van Santen, Steadman, Chiara & Simpson

[57] ABSTRACT

A side-opening composite looseleaf binding apparatus for attachment to a backbone of a looseleaf binder cover. The binding apparatus comprises a one-piece molded plastic base having a planar floor portion, a stationary wall portion, a hinged wall portion separated from the stationary wall portion by a floor portion, and wherein the hinged wall portion includes an integral plastic hinge. A one-piece stamped metal finger or ring unit is provided having a strip portion connected to the hinge wall portion and a plurality of curved fingers or rings extending from the strip portion. In a closed position, the curved fingers have ends which are adjacent to and below an upper edge of the stationary wall. A spring member provides an opening bias for the finger unit and a locking member locks the finger portions of the finger unit in a closed position.

17 Claims, 7 Drawing Figures

Fig. 1
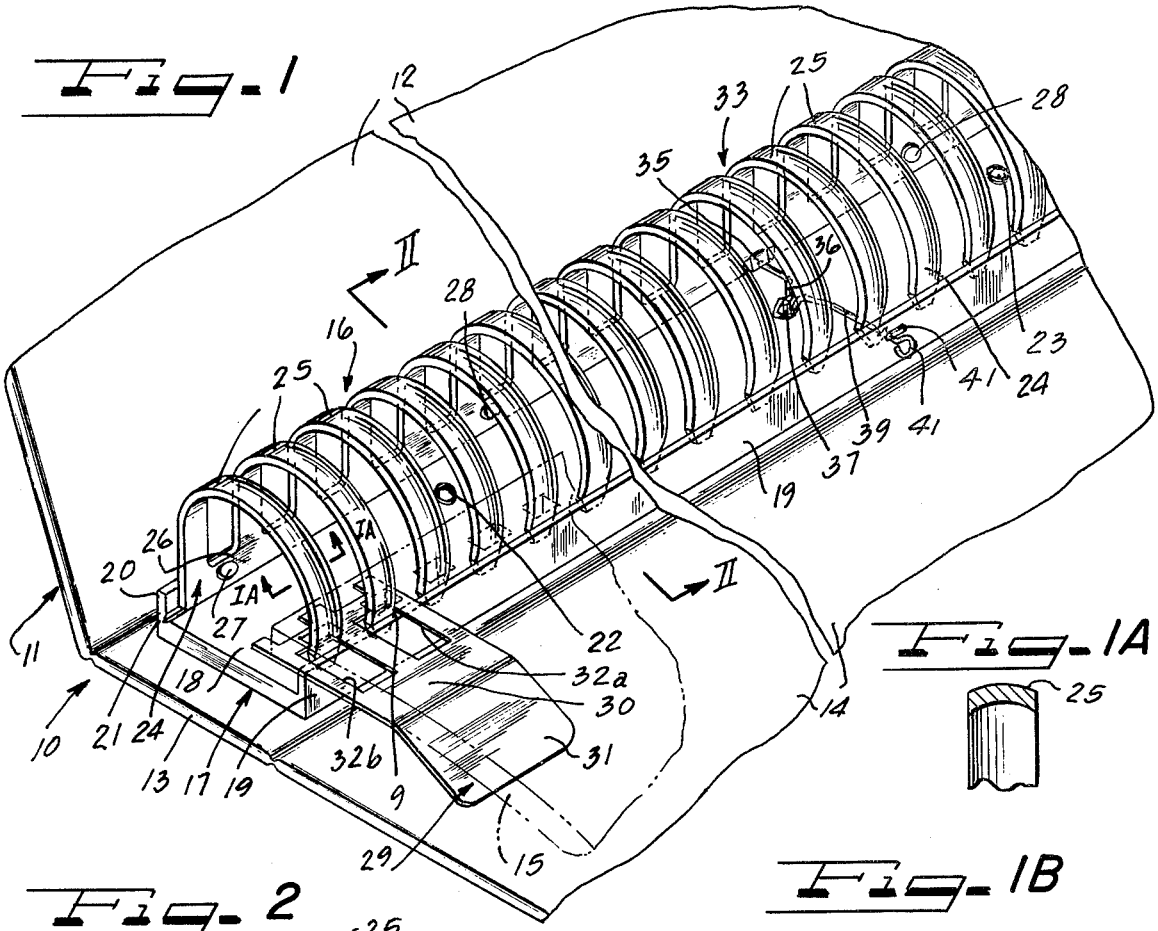
Fig. 1A
Fig. 1B
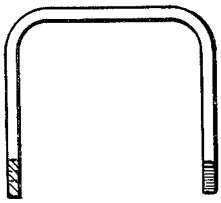
Fig. 2
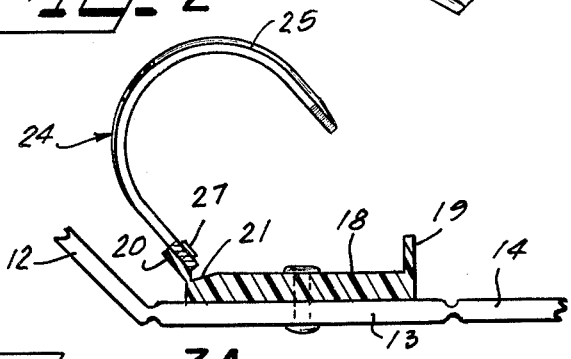
Fig. 3
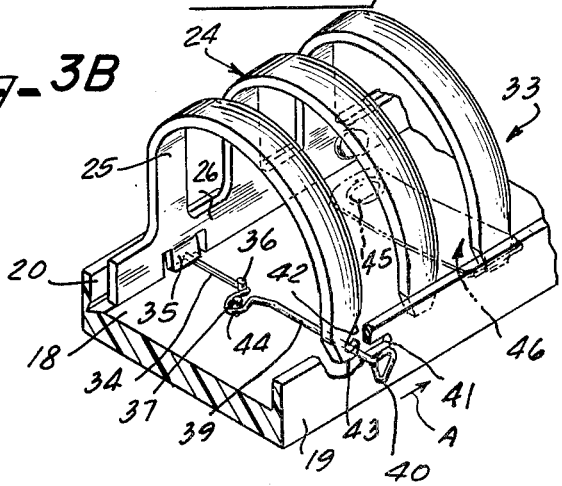
Fig. 3A
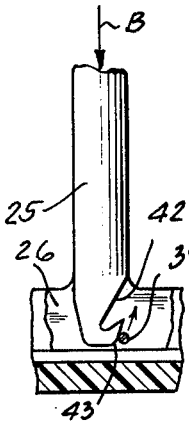
Fig. 3B
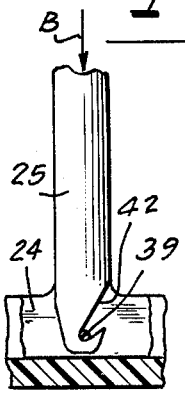

COMPOSITE LOOSELEAF MECHANISM

This is a continuation of application Ser. No. 873,277, filed Jan. 30, 1978 now abondoned.

BACKGROUND OF THE INVENTION

1. Field of the Invention

The invention relates to side-opening looseleaf binders.

2. Description of the Prior Art

Known looseleaf mechanisms are characterized by the use of a plurality of rings mounted within a book cover. The individual rings open to receive sheets of paper containing holes matching the particular ring locations. Once loaded, the rings are closed and the paper sheets are captured within the book although they are free to move on the rings in the open or closed book condition.

In known looseleaf mechanisms, paired half rings are employed which open or close simultaneously at their top portions with the book open and lying flat on its back.

Typically two to seven rings per long side of a standard sheet of paper may be employed or in multi-ring designs, as many as twenty-two rings may be employed. A large number of rings assists in distributing page turning wear on individual sheets.

In the known half ring mechanisms, opening of the rings is accomplished by tugging outwardly on the individual half rings. This practice inevitably results in paired rings eventually failing to match at the point of joining. This inhibits easy page turning and escalates page wear. To partially eliminate this problem, levers have been provided in known mechanisms which activate an internal spring toggle and cause all rings to snap open simultaneously. Closing is then accomplished by pressing the opened rings towards one another.

The above described known type of mechanism is sensitive to catastrophic failure if a loaded, closed binder is dropped on a hard surface. This causes the rings to partially open momentarily upon impact.

In order to avoid the above problems, it has been known to employ side opening looseleaf mechanisms. In one known type, three individual acting locking rings per long side of a standard sheet of paper are employed. Each of these locking rings, however, must be individually opened and closed since each locking ring has a slight ball on the end which fits into a slightly smaller aperture. This mechanism is inexpensive since it can possibly be molded in one piece in polyethylene. However, it is time consuming to open and close the individual rings. Other types of side-opening looseleaf mechanisms are known which utilize a set of rings which open or close simultaneously. However, in such structures, large numbers of parts are needed as is well known in the art.

SUMMARY OF THE INVENTION

It is an object of this invention to provide a side-opening looseleaf mechanism which is of low cost construction and employs a minimum number of one-piece components.

It is another object of this invention to provide a low cost looseleaf mechanism of the side-opening type which has a positive locking mechanism to prevent accidental opening.

According to the invention, a side-opening looseleaf binding apparatus is provided which has a molded one-piece thermoplastic base having a floor portion, a stationary wall portion, and a hinged wall portion separated from the stationary wall portion by the floor portion. A one-piece finger or ring unit has a strip portion mounted to the hinged wall portion of the base. A plurality of U-shaped finger portions protrude from the strip portion such that in a closed position ends of the finger portions lie adjacent the stationary wall portion and below a top edge thereof. A spring member biases the finger unit and attached hinge wall towards an open position while a locking member secures at least one end of one of the finger portions adjacent the stationary wall portion.

In the invention, the use of a molded one-piece thermoplastic base in combination with a one-piece finger unit simplifies construction and lowers cost. Also, it is preferable if a one-piece spring and locking member is used to perform both functions of biasing the rings toward an open position and locking the rings in a closed position.

In a method of the invention for constructing the side-opening looseleaf binding apparatus in a particularly low cost manner, a one-piece thermoplastic base is molded which has a floor, stationary wall and hinged wall. Also, a one-piece metal finger unit may be stamped to provide the strip portion and protruding finger portions. The finger portions are bent into the desired curvature and the finger unit is mounted via its strip portion on the hinged wall. Thereafter, a one piece locking component is mounted.

With the side-opening looseleaf mechanism of the invention, the wear on pages is reduced since they are not required to jump a gap. Also, smooth page turning is facilitated.

The assembled apparatus is inherently designed for high loads and the metallic fingers will not distort.

The apparatus is simple to manufacture and consists of low cost components such as the molded-in hinge within the molded thermoplastic base. Color options may also be molded in. Easy and positive locking is provided which prevent catastrophic failure. Effortless unlocking and opening is provided. Finally, the apparatus is safe to use, unlike the half ring apparatus wherein a user's fingers may become trapped between the closing half rings.

BRIEF DESCRIPTION OF THE DRAWINGS

FIG. 1 is a perspective view of a looseleaf apparatus of this invention mounted to the backbone of a looseleaf cover;

FIG. 1A is a cross-sectional view of one of the rings of the binder of FIG. 1 taken along line 1A—1A.

FIG. 1B is a side view of an alternate embodiment for the shape of the rings of the apparatus of FIG. 1;

FIG. 2 is a cross-sectional view taken along line II—II illustrating the rings or fingers of the apparatus in an open position;

FIG. 3 is a fragmentary detailed perspective view of the locking mechanism and spring opening mechanism of the apparatus of FIG. 1;

FIG. 3A is a fragmentary front view illustrating the locking mechanism of FIG. 3 in a partially closed position; and FIG. 3B is a partial front view of the locking mechanism of FIG. 3 illustrating a locked position.

DESCRIPTION OF THE PREFERRED EMBODIMENTS

A composite looseleaf binder of the invention is generally shown at 10 in FIG. 1. A binder cover 11 is provided having cover leaves 12 and 14 and a cover backbone 13 connecting the cover leaves. One or more paper sheets 15 with apertures 9 are placed in the binder through rings or fingers 25 of the looseleaf binder apparatus 16 of this invention.

The looseleaf apparatus 16 consists of a molded one-piece high density polyethylene base 17 having a substantially planar floor portion 18. A stationary wall portion 19 is provided along one edge of the floor 18 and a hinged wall portion 20 along a parallel opposite edge of the floor portion 18. A molded plastic hinge 21 connects the hinged wall portion 20 to the floor portion 18. Apertures 22 and 23 are provided for mounting rivets for attaching the base 17 to the backbone 13 of the cover.

A ring or finger unit 24 is provided which has a plurality of ring or finger portions 25 preferably formed of steel. As shown in FIG. 1, these fingers may be in a substantially U-shape or may be somewhat rectangular as shown in FIG. 1B. Also, the finger portions 25 may have a curved width as shown in FIG. 1A for added structural rigidity.

An integral connecting strip portion 26, from which the plurality of fingers 25 protrude, is mounted to the inside surface of the hinged wall portion 20 by use of integrally molded mounting studs 27 and 28 which protrude from the inside surface of the hinged wall. These studs are preferably positioned through apertures in the strip portion 26 of the ring unit 24 and are then deformed such as by melting in rivet-like fashion.

Also, as shown in FIG. 1, an automatic page release mechanism 29 may be provided which prevents binding of retained sheets when a large number of such sheets are to one side of the binder. The automatic page release mechanism 29 includes a page support portion 30 and a downturned portion 31. Apertures **32*a* and 32*b* connect the release mechanism 29 to two of the fingers of the finger unit 24**.

In a closed position, ends of the locking rings are below an upper edge of the stationary wall portion 19 so as to retain the sheets of paper such as 15 to the rings.

FIG. 2 illustrates the molded hinge 21 and rings 25 in an open position.

FIG. 3 is a more detailed view of the locking and spring mechanism of the apparatus of the invention. A lock and spring opening mechanism 33 is shown wherein an upwardly biased spring arm member 34 has one end biased against a tag or kick-out 35 of the strip portion 26. This biases the ring unit 24 towards an opening position. The spring arm member 34 is mounted by molded posts 36 and 37 in the base floor portion 18.

To affect locking of the rings or fingers in a closed position, a locking spring arm 39 is provided which is preferably integral with the spring arm 34 and wraps around the post 37 at a curved portion 44. A finger activating member 40 is provided at the end of the locking spring arm. A slot 41 provided in the stationary wall portion 19 prevents vertical movement of the locking arm 39 and also positions the locking arm for engagement with a downwardly slanting notch 42 in one of the locking finger portions 25. A cam surface 43 is provided at an end of the locking finger so as to cause movement of the arm 39 along the slot 41 and into engagement with the notch 42 when the ring is pushed downwardly in a direction B as shown in FIG. 3A. FIG. 3B illustrates engagement of the arm 39 and the notch 42.

Movement of the finger activating member 40 in a horizontal direction A shown in FIG. 3 unlocks the rings.

In an alternate embodiment, as shown in dotted lines at 46, a plate-like spring may be provided which is attached such as by a rivet at 45 and which has its opposite end under an end of one of the locking rings 25. This strip-like spring biases the rings upwardly in a fashion similar to the arm 34 but at an opposite end of the locking rings 25.

In a method of assembling the invention, the base is molded. The finger unit is stamped and the finger portions are bent into the desired curvature. The one-piece opening spring and locking mechanism is fashioned and slipped into place. The finger unit is snapped into place over the molded studs and heat is applied for staking. Thereafter, the assembly is riveted into a binder.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A side-opening composite looseleaf binding apparatus for attachment to a backbone of a looseleaf binder cover, comprising:

(a) a one-piece molded plastic base having a planar floor portion, a stationary integral wall portion at a first edge of and in a fixed substantially perpendicular position relative to the floor portion, and a hinged wall portion joined by an integral hinge positioned at a second edge of the floor portion parallel to the first edge;

(b) an integral rigid one-piece comb-like stamped metal finger unit comprising a strip portion with a flat mounting surface and a plurality of substantially rigid curled and aligned finger portions forming all the fingers of the binder and extending from the strip portion;

(c) connecting means mounting the flat mounting surface of the strip portion to a flat surface of the hinged wall portion, said finger portions being formed such that in a closed position of the looseleaf apparatus ends of said finger portions are directly adjacent the stationary wall portion;

(d) locking means for securing at least one of said finger portion ends adjacent said stationary wall portion; and (e) means for biasing the finger unit away from a closed position.

2. The apparatus of claim 1 in which said locking means comprises a notch in one of said finger portions and an arm spring receivable in said notch.

3. The apparatus of claim 2 in which said finger portion end has a curved surface and said arm spring is positioned to ride over said curved surface when the apparatus is closed.

4. The apparatus of claim 2 in which said arm spring is secured to said base floor portion and has one end aligned in a slot of said stationary wall portion.

5. The apparatus of claim 1 in which said connecting means comprises a portion of the base molded as a stud which is positioned in an aperture of the metal finger unit strip portion.

6. The apparatus of claim 5 in which an end of the stud is deformed in rivet-like fashion.

7. The apparatus of claim 1 in which spring means are provided for biasing the metal finger unit and attached hinged wall portion away from a closed position.

8. A side-opening composite looseleaf binding apparatus for attachment to a backbone of a looseleaf binder cover, comprising:

(a) a molded plastic base having a planar floor portion, a stationary integral wall portion at a first edge of the floor portion, and an integral hinged wall portion at a second edge of the floor portion parallel to the first edge, said hinged wall portion including an integral plastic hinge of the same material as the wall and floor portions;

(b) an integral stamped metal finger unit comprising a strip portion and a plurality of formed finger portions extending from the strip portion;

(c) connecting means mounting the strip portion to the hinged wall portion, said finger portions being formed such that in a closed position of the looseleaf apparatus ends of said finger portions are directly adjacent the stationary wall portion;

(d) locking means for securing one of said finger portion ends adjacent said stationary wall;

(e) spring means for biasing the metal finger unit and attached hinged wall portion away from a closed position; and (f) said spring means comprising a strip having one end biased against one of the ends of the finger portions adjacent the stationary wall portion.

9. The apparatus of claim 1 in which the finger portions are substantially U-shaped.

10. The apparatus of claim 9 in which the base floor portion has molded mounting apertures.

11. The apparatus of claim 1 in which the finger portions comprise curved metal strips.

12. The apparatus of claim 11 in which the strips are slightly curved across their width for increased rigidity.

13. The apparatus of claim 1 in which ends of the finger portions are positioned below a top edge of the stationary wall when the finger unit is in a closed position.

14. A side-opening composite looseleaf binding apparatus for attachment to a backbone of a looseleaf binder cover, comprising:

(a) a molded plastic base having a planar floor portion, a stationary integral wall portion at a first edge of the floor portion, and an integral hinged wall portion at a second edge of the floor portion parallel to the first edge, said hinged wall portion including an integral plastic hinge of the same material as the wall and floor portions;

(b) an integral stamped metal finger unit comprising a strip portion and a plurality of formed finger portions extending from the strip portion;

(c) connecting means mounting the strip portion to the hinged wall portion, said finger portions being formed such that in a closed position of the looseleaf apparatus ends of said finger portions are directly adjacent the stationary wall portion;

(d) locking means for securing one of said finger portion ends adjacent said stationary wall;

(e) spring means for biasing the metal finger unit and attached hinged wall portion away from a closed position; and said spring means comprising an arm spring member having one end biased against a protrusion on the finger unit strip portion.

15. The apparatus of claim 14 wherein said locking means comprises an arm spring receivable in a notch at an end of one of said finger portions.

16. A method of constructing a side-opening looseleaf binding apparatus for attachment to a backbone of a binder cover, comprising the steps of:

(a) molding a one-piece thermoplastic base comprising a floor portion, integral stationary wall portion fixed in position perpendicular to the floor portion, an integral hinged wall portion including a thermoplastic hinge between the wall portion and floor portion, an integral molded mounting means on the hinged wall portion;

(b) providing all fingers for the binding by stamping a planar one-piece rigid comb-like metal finger unit having a strip portion, protruding aligned and rigid finger portions, and mounting means on the strip portion;

(c) bending the finger portions into a substantially U-shape beginning directly at the strip portion; and (d) mounting a flat surface of the strip portion on the hinged wall with the integral mounting means on the hinged wall.

17. The method of claim 16 wherein a spring opening means is mounted which is a part of the one-piece lock means.

* * * * *